US006821386B2

(12) United States Patent
Weisman et al.

(10) Patent No.: US 6,821,386 B2
(45) Date of Patent: Nov. 23, 2004

(54) SMOOTH, MICROPEAK-CONTAINING THROUGH AIR DRIED TISSUE

(75) Inventors: Paul Thomas Weisman, Cincinnati, OH (US); Scott Thomas Loughran, West Chester, OH (US); Dean Phan, West Chester, OH (US); Paul Dennis Trokhan, Hamilton, OH (US); Robert Stanley Ampulski, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/361,323

(22) Filed: Feb. 10, 2003

(65) Prior Publication Data

US 2003/0136530 A1 Jul. 24, 2003

Related U.S. Application Data

(60) Continuation-in-part of application No. 09/206,517, filed on Dec. 7, 1998, now Pat. No. 6,551,453, which is a continuation-in-part of application No. 09/017,311, filed on Feb. 2, 1998, now Pat. No. 6,106,670, and a continuation of application No. 08/854,592, filed on May 12, 1997, now Pat. No. 5,980,691, said application No. 09/017,311, filed on Feb. 2, 1998, and a continuation of application No. 08/679,994, filed on Jul. 15, 1996, now Pat. No. 5,728,268, which is a continuation of application No. 08/370,716, filed on Jan. 10, 1995, now abandoned, said application No. 08/854,592, filed on May 12, 1997, and a continuation of application No. 08/461,293, filed on Jun. 5, 1995, now abandoned, which is a division of application No. 08/370,717, filed on Jan. 10, 1995, now abandoned.

(51) Int. Cl.[7] ..... D21F 11/00
(52) U.S. Cl. ..... 162/109; 162/117
(58) Field of Search ..... 162/109, 111, 162/116, 117; 428/153, 154

(56) References Cited

U.S. PATENT DOCUMENTS

| | | | | |
|---|---|---|---|---|
| 1,224,650 | A | | 5/1917 | Kitchen |
| 3,044,228 | A | | 7/1962 | Peterson |
| 3,124,504 | A | | 3/1964 | Mahoney et al. |
| 3,203,850 | A | | 8/1965 | McCarty |
| 3,230,136 | A | | 1/1966 | Krake |
| 3,291,678 | A | | 12/1966 | Enloe et al. |
| 3,301,746 | A | | 1/1967 | Sanford et al. |
| 3,905,863 | A | | 9/1975 | Ayers |
| 4,016,030 | A | | 4/1977 | Sobota |
| 4,087,319 | A | | 5/1978 | Linkletter |
| 4,179,330 | A | | 12/1979 | Page |
| 4,191,609 | A | | 3/1980 | Trokhan |
| 4,236,963 | A | | 12/1980 | Busker |
| 4,300,981 | A | | 11/1981 | Cartstens |
| 4,431,045 | A | | 2/1984 | Josefsson |
| 4,528,239 | A | | 7/1985 | Trokhan |
| 4,637,859 | A | | 1/1987 | Trokhan |
| 4,834,838 | A | | 5/1989 | Klowak |
| 5,246,545 | A | | 9/1993 | Ampulski et al. |
| 5,354,425 | A | | 10/1994 | Mackey et al. |
| 5,728,268 | A | * | 3/1998 | Weisman et al. |
| 6,106,670 | A | * | 8/2000 | Weisman et al. |

FOREIGN PATENT DOCUMENTS

| | | |
|---|---|---|
| EP | 0 342 646 A2 | 11/1989 |
| EP | 0 616 074 A1 | 3/1993 |
| EP | 0 613 979 A1 | 9/1994 |
| EP | 0 617 164 A1 | 9/1994 |
| EP | 0 631 014 A1 | 12/1994 |
| WO | WO 94/24366 A1 | 10/1994 |
| WO | WO 94/28239 A1 | 12/1994 |

* cited by examiner

*Primary Examiner*—Brenda A Lamb
(74) *Attorney, Agent, or Firm*—C. Brant Cook; David M. Weirich; Ken K. Patel

(57) ABSTRACT

A smooth, high density tissue. The tissue has a relatively low caliper, as well as high smoothness and high density. The tissue is calendered from a multidensity, through air dried web. The tissue comprises micropeaks.

15 Claims, 2 Drawing Sheets

SMOOTH, MICROPEAK-CONTAINING THROUGH AIR DRIED TISSUE

RELATED APPLICATIONS

This application claims priority to and is a continuation-in-part of commonly assigned U.S. application Ser. No. 09/206,517 filed Dec. 7, 1998, now U.S. Pat. No. 6,551,453, which is a continuation-in-part of U.S. application Ser. No. 09/017,311 filed Feb. 2, 1998, now U.S. Pat. No. 6,106,670, which is a continuation of U.S. application Ser. No. 08/679,994 filed held Jul. 15, 1996, now U.S. Pat. No. 5,728,268, which is a continuation of U.S. application Ser. No. 08/370,716 filed Jan. 10, 1995, abandoned, and is a continuation of commonly assigned U.S. application Ser. No. 08/854,592 filed May 12, 1997, now U.S. Pat. No. 5,980,691, which is a continuation of U.S. application Ser. No. 08/461,293 filed Jun. 5, 1995, abandoned, which is a divisional of U.S. application Ser. No. 08/370,717 filed Jan. 10, 1995, abandoned.

FIELD OF THE INVENTION

This invention relates to tissue and more particularly to tissue having a soft tactile sensation.

BACKGROUND OF THE INVENTION

Tissue is well known in the art and a staple of everyday life. Tissue is commonly divided into two uses—toilet tissue and facial tissue. Both require several attributes in order to be accepted by the consumer. One of the most important attributes is softness.

Softness is a subjective evaluation of the tactile sensation the user feels when handling or using the tissue. Softness cannot be directly measured. However relative softness values can be measured in panel score units (PSU) according to he technique set forth in commonly assigned U.S. Pat. No. 5,354,425 issued Oct. 11, 1994 to Mackey et al., except that the samples are not allowed to be judged equally soft. This patent is incorporated herein by reference. Softness has been found to be related to 1) the surface topography of the tissue, 2) the flexibility of the tissue, and 3) the slip-stick coefficient of friction of the surface of the tissue.

Several attempts have been made in the art to improve softness by increasing the flexibility of the tissue. For example, commonly assigned U.S. Pat. No. 4,191,609 issued to Trokhan has proven to be a commercially successful way to increase flexibility through a bilaterally staggered arrangement of low density regions. However, it has been well recognized in the art that multi-density tissues, which provide very high and commercially successful flexibility and softness, have an inherently distinctive topography.

However, improving, and even maintaining, softness by providing a smoother surface topography has proven to be elusive. The reason for this elusiveness is the trade-off between the smoother surface topography and increased density. Typically, densification increases fiber to fiber contacts, potentially causing bonding at the contact points. This negatively impacts flexibility and hence softness. This interdependent density/softness relationship has been referred to as virtually axiomatic in the commonly assigned U.S. Pat. No. 4,300,981 issued Nov. 17, 1994 to Carstens. The Carstens '981 patent also discusses the PSU softness measurement and is incorporated herein by reference. This relationship is also stated in competitive European Patent Application 0 613 979 A1, published Sep. 7, 1994, as increased void volume (i.e., decreased density) correlates with improved softness. Unfortunately, this trade-off has inimical effects for tissue products sought by the consumers.

Unexpectedly, applicants have found a way to decouple the prior art relationship between density and softness. Accordingly, it is now possible to improve the surface topography of tissue without encountering the concomitant loss of softness that occurs in the prior art. Therefore, softness levels, previously unattainable at relatively high densities, are possible with the present invention. Also, unexpectedly, absorbency is maintained at the higher density. This is contrary to prior art beliefs, as illustrated by European Patent Application 0 616 074 A1, which holds lower density results in more bulky and absorbent sheets.

Further unexpectedly, it has been found necessary to utilize a multidensity substrate to make tissue according to the present invention. This is unexpected because multidensity tissue, particularly through air dried tissue, generally has a lesser density than conventionally dried tissue having a uniform density throughout. Thus, rather than using high density tissue as a starting point in the calendering process, one must utilize relatively lower density tissues as the starting point.

SUMMARY OF THE INVENTION

Figure 1:
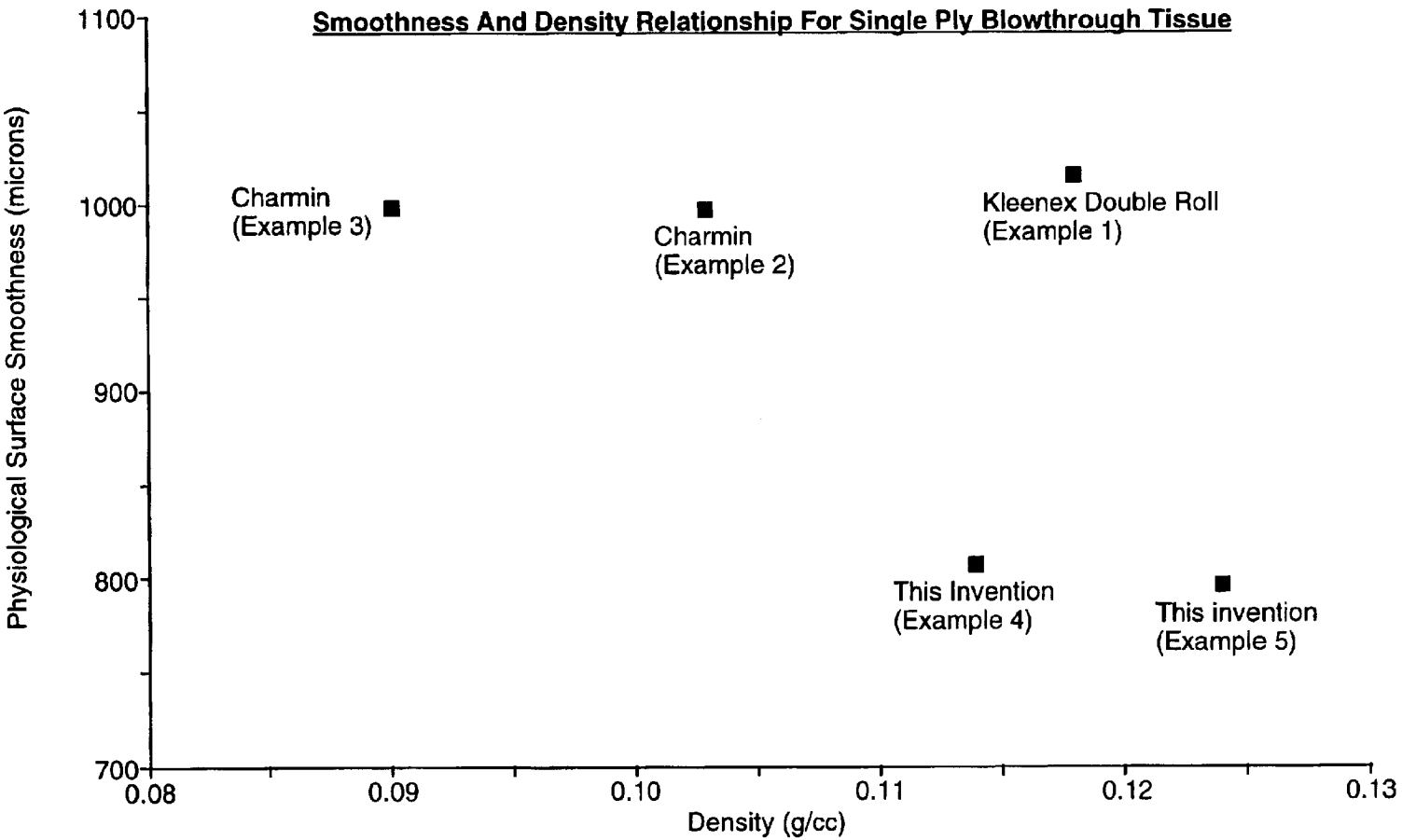
FIG. 1 is a graphical representation of the relationship between smoothness and density for the tissues set forth in Examples 1 to 5 below.

The invention comprises a sheet of tissue. The tissue is a macroscopically monoplanar multidensity cellulosic fibrous structure. The tissue has a smoothness with a physiological surface smoothness of less than or equal to about 900 and/or less than or equal to about 800 microns, preferably less than or equal to about 750 microns, and more preferably less than or equal to about 700 microns and yet more preferably less than or equal to about 650 microns.

The tissue may be made from a through air dried substrate. The substrate may be dried to a moisture level of about 1.9 to about 3.5 percent. The tissue may then be calendered at a pressure of about 90 to 180 psi, and 130 to 300 pli in the nip.

DETAILED DESCRIPTION OF THE INVENTION

The tissue according to the present invention comprises a macroscopically monoplanar cellulosic fibrous structure. The tissue is two dimensional, although not necessarily flat. By "macroscopically monoplanar" it is meant that the tissue lies principally in a single plane, recognizing that undulations in surface topographies do exist on a micro scale. The tissue, therefore, has two opposed faces. The term "cellulosic" means the tissue comprises at least 50% cellulosic fibers. The cellulosic fibers may either be hardwood or softwood, and processed as kraft, thermomechanical, stone-ground pulp, etc. all of which are well known in the art and do not comprise part of the present invention. The term "fibrous" refers to elements which are fiber-like, having one major axis with a dimension significantly greater than the other two dimensions orthogonal thereto. The term sheet refers to a macroscopically monoplanar formation of cellulosic fibers which is taken off the forming wire as a single lamina and which does not change in basis weight unless fibers are added to or removed therefrom. It is to be recognized that two, or more sheets, may be combined together—with either or both having been made according to the present invention.

The tissue of the present invention is through air dried, and may be made according to either of commonly assigned U.S. Pat. No. 4,191,609 issued Mar. 4, 1980 to Trokhan; U.S. Pat. No. 4,637,859 issued Jan. 20, 1987 to Trokhan; or U.S. Pat. No. 5,334,289 issued Aug. 2, 1994 issued to Trokhan et al.—all of which patents are incorporated herein by reference. Through air drying according to the aforementioned patents produces a multidensity tissue. Multidensity, through air dried tissues generally have a lesser density than tissues conventionally dried using a press felt and comprising a single region of one density. Particularly, a multidensity tissue made according to the three aforementioned patents comprises two regions, a high density region and discrete protuberances. The protuberances are of particularly low density relative to the balance of the tissue. The high density regions may comprise discrete regions juxtaposed with the low density regions or may comprise an essentially continuous network.

The tissue preferably, but not necessarily, is layered according to commonly assigned U.S. Pat. No. 3,994,771 issued to Morgan et al., which patent is incorporated herein by reference.

The tissue according to the present invention has a smoothness with a physiological surface smoothness (PSS) of less than or equal to about 800 microns, preferably less than or equal to about 750 microns, and more preferably less than or equal to about 700 microns and yet more preferably less than or equal to about 650 microns.

The physiological surface smoothness is measured according to the procedure set forth in the 1991 International Paper Physics Conference, TAPPI Book 1, more particularly the article entitled "Methods for the Measurement of the Mechanical Properties of Tissue Paper" by Ampulski et al. and found at page 19. The specific procedure used is set forth at page 22, entitled "Physiological Surface Smoothness." However, the PSS value obtained by the method set forth in this article are multiplied by 1,000, to account for the conversion from millimeters to microns. This article is incorporated herein by reference for the purpose of showing how to make smoothness measurements of tissue made according to the present invention. Physiological surface smoothness is also described in commonly assigned U.S. Pat. No. 4,959,125 issued Sep. 25, 1990 to Spendel and U.S. Pat. No. 5,059,282 issued Oct. 22, 1991 to Ampulski et al., which patents are incorporated herein by reference.

For the smoothness measurement, a sample of the tissue is selected. The sample is selected to avoid wrinkles, tears, perforations, or gross deviations from macroscopic monoplanarity. The sample is conditioned at 71 to 75 degrees F. and 48 to 52 percent relative humidity for at least two hours. The sample is placed on a motorized table, and magnetically secured in place. The only deviation from the aforementioned procedure is that sixteen traces (eight forward, eight reverse) per sample are utilized, rather than the twenty traces set forth in the aforementioned paper. Each forward and reverse trace is transversely offset from the adjacent forward and reverse trace about one millimeter. All sixteen traces are averaged from the same sample to yield the smoothness value for that sample.

Either face of the tissue may be selected for the smoothness measurement, provided all traces are taken from the same face. If either face of the tissue meets any of the smoothness criteria set forth herein, the entire sample of the tissue is deemed to fall within that criterion. Preferably both faces of the tissue meet the above criteria.

The tissue according to the present invention preferably has a relatively low caliper. Caliper is measured according to the following procedure, without considering the microdeviations from absolute planarity inherent to the multidensity tissues made according to the aforementioned incorporated patents.

The tissue paper is preconditioned at 71° to 75° F. and 48 to 52 percent relative humidity for two hours prior to the caliper measurement. If the caliper of toilet tissue is being measured, 15 to 20 sheets are first removed from the outside of the roll and discarded. If the caliper of facial tissue is being measured, the sample is taken from near the center of the package. The sample is selected and then conditioned for an additional 15 minutes.

Caliper is measured using a low load Thwing-Albert micrometer, Model 89-11, available from the Thwing-Albert Instrument Company of Philadelphia, Pa. The micrometer loads the sample with a pressure of 95 grams per square inch using a 2.0 inch diameter presser foot and a 2.5 inch diameter support anvil. The micrometer has a measurement capability range of 0 to 0.0400 inches. Decorated regions, perforations, edge effects, etc., of the tissue should be avoided if possible.

The caliper of tissue according to the present invention is preferably less than or equal to about 11 mils, more preferably less than or equal to about 10 mils, and still more preferably less than or equal to about 9.5 mils. One skilled in the art will understand a mil is equivalent to 0.001 inches.

The tissue according to the present invention preferably has a basis weight of about 7 to about 35 pounds per 3,000 square feet. Basis weight is measured according to the following procedure.

The tissue sample is selected as described above, and conditioned at 71° to 75° F. and 48 to 52 percent relative humidity for a minimum of 2 hours. A stack of six sheets of tissue is placed on top of a cutting die. The die is square, having dimensions of 3.5 inches by 3.5 inches and may have soft polyurethane rubber within the square to ease removal of the sample from the die after cutting. The six samples are cut using the die, and a suitable pressure plate cutter, such as a Thwing-Albert Alfa Hydraulic Pressure Sample Cutter, Model 240-10. A second set of six samples is also cut this way. The two six-sample stacks are then combined into a 12 ply stack and conditioned for at least 15 additional minutes at 71° to 75° F. and 48 to 52 percent humidity.

The 12 ply samples are then weighed on a calibrated analytical balance having a resolution of at least 0.0001 grams. The balance is maintained in the same room in which the samples were conditioned. A suitable balance is made by Sartorius Instrument Company, Model A200S.

The basis weight, in units of pounds per 3,000 square feet, is calculated according to the following equation:

$$\frac{\text{Weight of 12 ply sample (grams)} \times 3000}{(453.6\ \text{grams/pound}) \times (12\ \text{plies}) \times (12.25\ \text{sq. in. per ply/144 sq. in/sq. ft.})}$$

The basis weight in units of pounds per 3,000 square feet for this 12 ply sample is more simply calculated using the following conversion equation:

$$\text{Basis Weight (lb/3,000 ft}^2\text{)} = \text{Weight of 12 ply pad (g)} \times 6.48$$

The units of density used here are grams per cubic centimeter (g/cc). With these density units of g/cc, it may be convenient to also express the basis weight in units of grams per square centimeters. The following equation may be used to make this conversion:

$$\text{Basis Weight (g/cm 2)} = \frac{\text{Weight of 12 ply pad (g)}}{948.4}$$

The tissue according to the present invention preferably has a relatively high density. The density of the tissue is calculated by dividing its basis weight by its caliper. Thus, density is measured on a macro-scale, considering the tissue sample as a whole, and without regard to the differences in densities between individual regions of the paper.

The tissue according to the present invention preferably has a density of at least about 0.100 grams per cubic centimeter, more preferably at least about 0.110 grams per cubic centimeter, and still more preferably at least about 0.120 grams per cubic centimeter, even more preferably at least about 0.130 grams per cubic centimeter.

The tissue according to the present invention comprises a macroscopically monoplanar, multidensity, through air dried cellulosic fibrous structure having two opposed faces, wherein at least one of said opposed faces comprises a micropeak thereon, said micropeak having a micropeak height and a micropeak width.

In one embodiment, at least one of the opposed faces of the tissue has a smoothness of less than or equal to about 900 microns and/or less than or equal to 800 microns. Preferably, both of the opposed faces of the tissue have a smoothness of less than or equal to about 900 microns and/or less than or equal to about 800 microns.

The process for making a tissue according to the present invention comprises the following steps. First an aqueous dispersion of papermaking fibers and a foraminous forming surface, such as a Fourdrinier wire, are provided. The embryonic web is contacted with the Fourdrinier wire to form an embryonic web of papermaking fibers on the wire. Also a through air drying belt, such as is described above, is provided. The Fourdrinier wire and embryonic web are then transferred to the through air drying belt. During the transfer, a differential pressure is applied through the through air drying belt. This differential pressure deflects regions of the tissue into the belt. These deflected regions are the low density regions discussed above, and are believed to be critical to making the tissue of the present invention—despite the fact that such low density regions are later calendered to a higher density.

A heated contact drying surface, such as a Yankee drying drum, is also provided. The web of cellulosic fibers is then brought into contact with the Yankee drying drum, and preferably impressed thereagainst. This impression further increases the local difference in density between the high and low density regions of the tissue. The tissue is then dried to the desired moisture level, as set forth below, on the Yankee drying drum. The appropriate moisture level may be about 0.3 to 0.4 percent higher than moisture levels for conventional calendering operations.

After drying, the tissue is calendered at a mean moisture level between about 1.9 and 3.5 percent, and preferably between about 2.5 and 3.0 percent. Relatively higher moisture levels provide greater densification at generally lower caliper pressures. However, as moisture levels increase, moisture profiles on the papermaking machine are generally exaggerated. Additionally, as moisture levels increase, the sheet becomes stiffer, and hence has less softness, possibly due to hydrogen bonding, transfer of adhesive from the Yankee drying drum, etc.

Density increases of 15 to 25 percent are typical according to the calendering operation of the present invention. It is to be understood that the calendering operation increases the density of the tissue as a whole, and may or may not provide uniform percentage density increases of all regions of the multidensity tissue.

The calendering is performed using two rolls juxtaposed to form a nip between the rolls. As will be recognized by one skilled in the art, calendering may be performed using more than two rolls, with the rolls being arranged in pairs to form multiple nips. It will be further apparent to one skilled in the art that the same roll may be used in more than one pair.

The rolls may be axially parallel. However, in order to accommodate the calender pressures desirable with the present invention, one of the rolls may be crowned. The axis of the other roll may be bent so that it conforms to the crown of the first roll. Alternatively, the axes of the rolls may be slightly skewed.

Either or both of the rolls forming the nip may be steel, rubber coated, fabric coated, paper coated, etc. Either or both rolls may be maintained at a temperature optimum for roll life, i.e., to prevent overheating of the roll, or at a temperature which heats the substrate. One roll may be externally driven, the other may be frictionally driven by the first roll, so that slip is minimized.

The pairs of rolls are loaded together with a nip pressure of about 90 to 180 psi, and preferably with a nip pressure of about 110 to 150 psi. This loading provides a lineal nip pressure of 130 to 300 pli, and more preferably about 175 to 250 pli. One skilled in the art will recognize that the nip width can be obtained by dividing the lineal nip pressure in pli by the nip pressure in psi (pli/psi).

The merits of, and techniques for making, the present invention are illustrated by the following nonlimiting examples.

Each of the samples below represents a single ply, through air dried tissue. The first three examples are according to the prior art. The fourth through sixth examples are according to the present invention, and were selected to illustrate the invention is feasible, even at low moisture levels. For consistency, the smoothness measurements are reported for the Yankee side of each sample. Although not required by the protocol, each smoothness measurement represents an average of four samples (16 traces per sample) for that particular example, except as noted below for Example 6. Each sample tested in Examples 1 to 5 was taken from a different roll. The softness measurements (in PSU) were made using Charmin brand toilet tissue, as currently marketed by The Procter & Gamble Company of Cincinnati, Ohio, as the standard.

EXAMPLE 1

Kleenex Double Roll brand toilet tissue, manufactured by the Kimberly-Clark Corporation of Dallas, Tex. was used for Example 1. The Kleenex Double Roll tissue of Example 1 had a caliper of 9.7 mils, a smoothness of 1011 microns, and a softness of −0.93 PSU.

EXAMPLE 2

Charmin brand toilet tissue sold by the instant assignee, The Procter & Gamble Company of Cincinnati, Ohio, was made in Albany, Ga. This tissue was dried on a five shed, Atlas weave fabric made according to commonly assigned U.S. Pat. No. 4,239,065 issued to Trokhan. The fabric had a warp count of 44 fibers per inch and a weft count of 33 fibers per inch. The tissue was calendered in a rubber to steel nip at a pressure of about 20 to 40 psi and about II to 32 pli at a mean moisture level of about 2.5 percent. The Charmin tissue of Example 2 had a caliper of 11.2 mils, a smoothness of 995 microns, and a softness of 0.08 PSU.

EXAMPLE 3

Charmin brand toilet tissue sold by the instant assignee, The Procter & Gamble Company of Cincinnati, Ohio, was made in Mehoopany, Pa. This tissue was dried on a five shed, Atlas weave fabric made according to commonly assigned U.S. Pat. No. 4,239,065 issued to Trokhan. The fabric had a warp count of 44 fibers per inch and a weft count of 33 fibers per inch. The tissue was calendered in a rubber to steel nip at a pressure of about 53 to 89 psi and about 53 to 77 pli at a mean moisture level of about 2.7 percent. The Charmin tissue of Example 3 had a caliper of 13.2 mils, a smoothness of 997 microns, and a softness of −0.28 PSU.

EXAMPLE 4

A single ply, through air dried toilet tissue according to the present invention was made in Albany, Ga. This tissue was dried on a five shed, Atlas weave fabric made according to commonly assigned U.S. Pat. No. 4,239,065 issued to Trokhan. The fabric had a warp count of 44 fibers per inch and a weft count of 33 fibers per inch. This tissue was calendered in a rubber to steel nip at a pressure of 110 psi and 143 pli and a mean moisture level of 2.1 percent. The tissue of Example 4 had a caliper of 9.4 mils, a smoothness of 805 microns, and a softness of 0.26 PSU.

EXAMPLE 5

A single ply, through air dried toilet tissue according to the present invention was made in Albany, Ga. This tissue was dried on a five shed, Atlas weave fabric made according to commonly assigned U.S. Pat. No. 4,239,065 issued to Trokhan. The fabric had a warp count of 59 fibers per inch and a weft count of 44 fibers per inch. The tissue was calendered in a rubber to steel nip at a pressure of 110 psi and 143 pli and a mean moisture level of 1.9 percent. The tissue of Example 5 had a caliper of 8.9 mils, a smoothness of 793 microns, and a softness of 0.30 PSU.

EXAMPLE 6

A single ply, through air dried toilet tissue according to the present invention was made in Albany, Ga. This tissue was dried on a five shed, Atlas weave fabric made according to commonly assigned U.S. Pat. No. 4,239,065 issued to Trokhan. The fabric had a warp count of 44 fibers per inch and a weft count of 33 fibers per inch. This tissue was calendered in a rubber to steel nip at a pressure of 175 psi and 285 pli and a mean moisture level of 2.1 percent. Only one finished product roll of the tissue of Example 6 was tested for smoothness. The tissue of Example 6 had a caliper of 8.5 mils, a smoothness of 696 microns on the Yankee face of the tissue, and a smoothness of 720 microns on the opposite face of the tissue. Both values are given in the following table.

The results of Examples 1 to 6 are illustrated in Table I. For completeness, Table I also provides the basis weight and density of each sample.

TABLE I

| EXAMPLE NUMBER | SOFTNESS (PSU) | SMOOTHNESS (MICRONS) | BASIS WEIGHT (POUNDS PER 3,000 SQUARE FEET) | CALIPER (MILS) | DENSITY (GRAMS PER CC) |
|---|---|---|---|---|---|
| 1 | −0.93 | 1011 | 17.9 | 9.7 | 0.118 |
| 2 | 0.08 | 995 | 18.0 | 11.2 | 0.103 |
| 3 | −0.28 | 997 | 18.6 | 13.2 | 0.090 |
| 4 | 0.26 | 805 | 16.7 | 9.4 | 0.114 |
| 5 | 0.3 | 793 | 17.2 | 8.9 | 0.124 |
| 6 | 0.46 | 696/720 | 17.1 | 8.5 | 0.129 |

Figure 2:
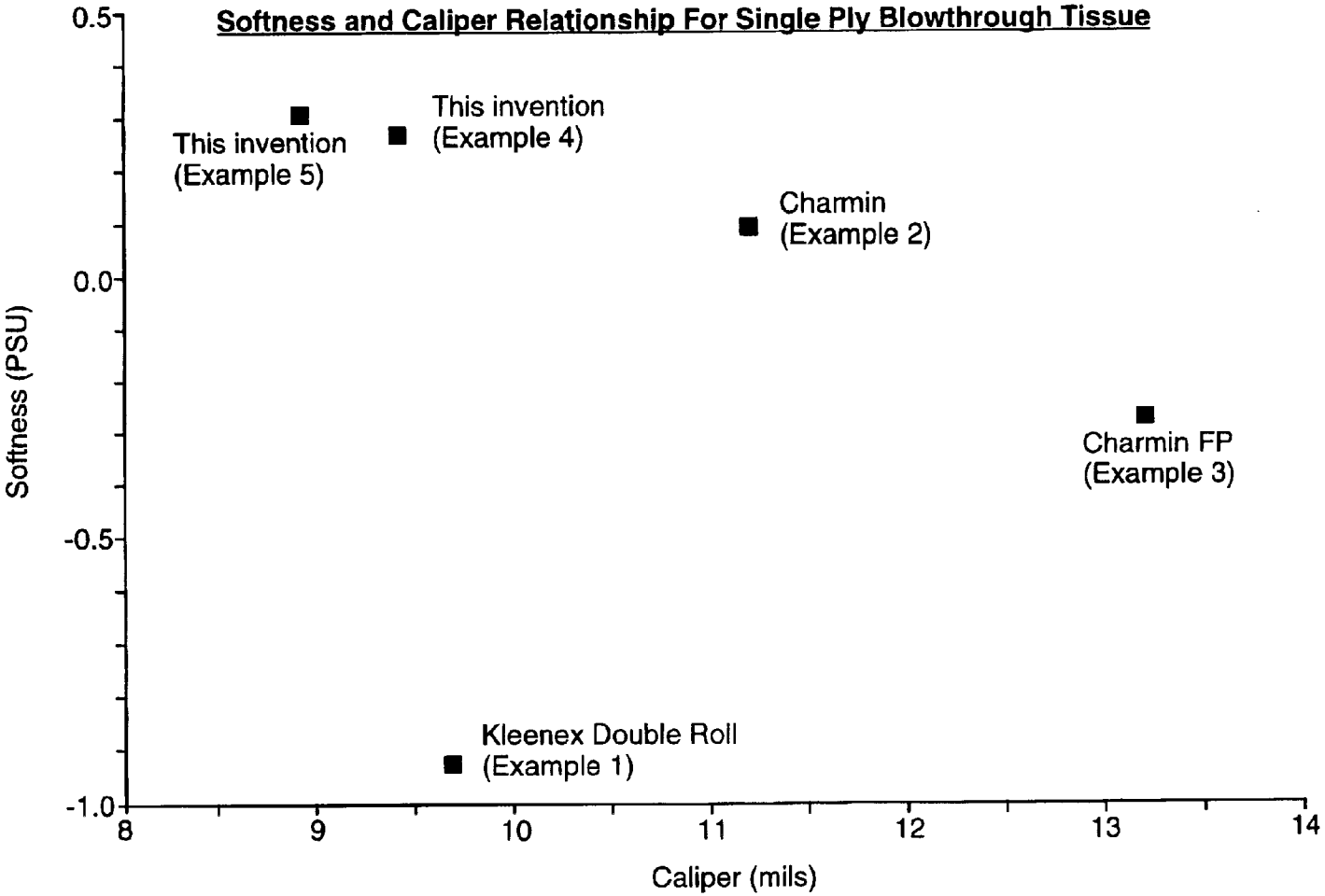
FIG. 2 is a graphical representation of the relationship between softness and caliper for the tissues set forth in Examples 1 to 5 below.

As can be seen from Table I, the three examples according to the present invention have a density approximately the same as that of the Kleenex example. However, the smoothness was considerably improved as graphically illustrated in FIG. 1. Similarly, the softness of the two examples according to the present invention was greatly improved over the prior art, even at the lower caliper levels achievable with the present invention, as graphically illustrated in FIG. 2.

It will be apparent to one skilled in the art that the aforementioned parameters may be optimized as necessary. For example, it may be feasible to have a tissue of lesser smoothness, providing it has the proper density. In particular a tissue with a smoothness less than or equal to about 900 microns, and having a density of at least about 0.120 grams per cubic centimeter may be feasible. Preferably both faces of such tissue have a smoothness of less than or equal to about 900 microns, although if either face meets this criterion the tissue is made according to the present invention. The density of such tissue may preferentially be increased to at least about 0.130 grams per cubic centimeter.

The softness of one face of the tissue may be less than or equal to about 900 microns, the softness of the other face may be less than or equal to about 800 microns. More preferably, the softness of one face of the tissue may be less than or equal to about 800 microns, the softness of the other face may be less than or equal to about 750 microns.

All such variation are within the scope of the appended claims.

What is claimed is:

1. A sheet of tissue comprising a macroscopically monoplanar, multi-density, through air dried cellulosic fibrous structure having two opposed faces, wherein at least one of said opposed faces has a smoothness of from about 650 to about 900 microns, said at least one face having micropeaks thereon.

2. The sheet of tissue according to claim 1 wherein said tissue has a caliper of less than or equal to about 11 rolls.

3. The sheet of tissue according to claim 1 wherein said at least one of said opposed faces has a smoothness of from about 650 to about 800 microns.

4. The sheet of tissue according to claim 1 wherein said at least one of said opposed faces has a smoothness of from about 650 to about 750 microns.

5. The sheet of tissue according to claim 1 wherein said at least one of said opposed faces has a smoothness of from about 650 to about 700 microns.

6. The sheet of tissue according to claim 1 wherein both of said two opposed faces have a smoothness of from about 650 to 900 microns.

7. The sheet of tissue according to claim 1 wherein said tissue has a density of at least about 0.100 grams per cubic centimeter.

8. The sheet of tissue according to claim 1 wherein said tissue has a density of at least about 0.110 grams per cubic centimeter.

9. The sheet of tissue according to claim 1 wherein said tissue has a density of at least about 0.120 grams per cubic centimeter.

10. The sheet of tissue according to claim 1 wherein said tissue has a density of at least about 0.130 grams per cubic centimeter.

11. The sheet of tissue according to claim 1 wherein said tissue has a caliper of less than or equal to about 10 mils.

12. The sheet of tissue according to claim 1 wherein said tissue has a caliper of less than or equal to about 9.5 mils.

13. The sheet of tissue according to claim 1 wherein said tissue has a basis weight of from about 7 to about 35 pounds per 3,000 square feet.

14. A sheet of tissue comprising a macroscopically monoplanar, multi-density, through air dried cellulosic fibrous structure having two opposed faces, wherein at least one of said opposed faces has a smoothness of less than about 900 microns, wherein said tissue has a caliper of from about 9.5 to about 11 mils.

15. The sheet of tissue according to claim 14 wherein said tissue has a caliper of from about 9.5 to about 10 mils.

* * * * *

UNITED STATES PATENT AND TRADEMARK OFFICE

CERTIFICATE OF CORRECTION

PATENT NO. : 6,821,386 B2
DATED : November 23, 2004
INVENTOR(S) : Paul Thomas Weisman et al.

It is certified that error appears in the above-identified patent and that said Letters Patent is hereby corrected as shown below:

Column 7,
Line 17, "II" should read -- 11 --.

Column 9,
Line 14, "rolls" should read -- mils. --

Signed and Sealed this

Fifteenth Day of February, 2005

JON W. DUDAS
*Director of the United States Patent and Trademark Office*